United States Patent [19]

Johnsen

[11] 4,178,769

[45] Dec. 18, 1979

[54] SYSTEM FOR PRODUCING REFRIGERATION AND A HEATED LIQUID AND CONTROL THEREFOR

[75] Inventor: Clifford N. Johnsen, La Crosse, Wis.

[73] Assignee: The Trane Company, La Crosse, Wis.

[21] Appl. No.: 918,529

[22] Filed: Jun. 23, 1978

Related U.S. Application Data

[62] Division of Ser. No. 872,406, Jan. 26, 1978, Pat. No. 4,134,274.

[51] Int. Cl.[2] ..... F25B 39/04; F25B 29/00

[52] U.S. Cl. ..... 62/180; 62/196 B; 62/218; 62/238

[58] Field of Search ..... 62/324 D, 238 E, 196 B, 62/218, 180, DIG. 17, 185

[56] References Cited

U.S. PATENT DOCUMENTS

| | | | |
|---|---|---|---|
| 2,787,128 | 4/1957 | Brown | 62/90 |
| 3,017,162 | 1/1962 | Haines et al. | 62/180 X |
| 3,188,829 | 6/1965 | Siewert et al. | 62/159 |
| 3,365,900 | 1/1968 | Clark et al. | 62/218 X |
| 3,916,638 | 11/1975 | Schmidt | 62/238 |
| 3,926,008 | 12/1975 | Webber | 62/200 |

*Primary Examiner*—William E. Wayner
*Attorney, Agent, or Firm*—Carl M. Lewis; Peter D. Ferguson

[57] ABSTRACT

The present invention relates to a refrigeration system of the type having an air cooled condenser which includes the further capability of producing a heated liquid in a liquid cooled or, "heat recovery" condenser. The system includes compressor means for compressing a vaporized refrigerant, air cooled condenser means having fan means for forcing air in heat exchange relationship therewith, liquid cooled condenser means for producing a heated liquid, and evaporator means for expanding and vaporizing condensed refrigerant in heat exchange relationship with a refrigeration load. Control means are provided for the system and include first means for sensing the demand for heated liquid from the liquid cooled condenser, and second means responsive to the first means for reducing the capacity of the fan means in response to increased demand for heated liquid. In another aspect of the invention, the liquid cooled condenser means include control means for maintaining a desired level of condensed refrigerant therein during operation in order to insure proper subcooling thereof. A complete control circuit for the system is disclosed.

5 Claims, 2 Drawing Figures

SYSTEM FOR PRODUCING REFRIGERATION AND A HEATED LIQUID AND CONTROL THEREFOR

This is a division of application Ser. No. 872,406 filed Jan. 26, 1978 now U.S. Pat. No. 4,134,274 issued Jan. 16, 1979.

BACKGROUND OF THE INVENTION

1. Field of the Invention

The present invention relates generally to the field of refrigeration, and specifically to those systems which operate to serve a refrigeration load such as a water chiller or direct expansion coil, and also to provide a source of heated liquid. Such systems are sometimes referred to as "heat recovery" systems. The present invention addresses itself to systems of this type wherein an air cooled condenser is utilized in addition to the liquid cooled condenser which provides the source of heated liquid.

2. Description of the Prior Art

The only prior art known to applicant which discloses a refrigeration system having both an air cooled condenser and a liquid cooled heat recovery condenser is U.S. Pat. No. 3,188,829. In this system, the liquid cooled condenser and air cooled condenser are in series flow relationship such that all refrigerant flowing in the system passes through both condensers, without condensed refrigerant level control for the liquid cooled condenser. Further, the fan provided for forcing air in heat exchange relationship with the air cooled condenser does not include any means for controlling its capacity when there is a demand for heated liquid from the liquid cooled condenser.

U.S. Pat. No. 2,787,128 discloses a refrigeration system which includes a first liquid cooled condenser and a second liquid cooled heat recovery condenser. In this system, the two condensers are connected in parallel flow relationship and means are provided for restricting the flow of cooling water to the first condenser during those times that a demand for heated liquid from the heat recovery condenser exists, thereby increasing the operating pressure within said condensers in order to provide hot liquid of a desired temperature.

U.S. Pat. No. 3,916,638 discloses another refrigeration system having two liquid cooled condensers, one of which is adapted for heat recovery. In this system, the heat recovery condenser may be taken out of the refrigerant flow circuit through the actuation of appropriate valve means such that, during those times when there is no demand for heated liquid the refrigerant does not flow through the heat recovery condenser. When such demand exists, however, the condensers are in series flow relationship such that all refrigerant in the system must flow through both condensers.

SUMMARY OF THE INVENTION, OBJECTS

The present invention relates to a system for producing refrigeration and which is selectively operable to produce a heated liquid. The system includes compressor means for compressing a vaporized refrigerant and air cooled condenser means connected thereto for condensing the compressed refrigerant by heat exchange with a source of air. Suitable fan means are provided for forcing air in heat exchange with the air cooled condenser means. Also connected to the compressor means are liquid cooled condenser means for receiving compressed refrigerant and condensing same by heat exchange with a source of liquid, thereby producing a source of heated liquid for use as desired. Evaporator means are provided for expanding and vaporizing the condensed refrigerant in heat exchange relationship with the refrigeration load and returning the resultant vaporized refrigerant to the compressor means. In order to complete the refrigerant circuit means are provided for transferring condensed refrigerant from the air cooled and liquid cooled condenser means to the evaporator means.

In order to control the capacity of the air cooled condenser means during those times that a demand for heated liquid exists, control means are provided which include first means for sensing the demand for heated liquid and second means responsive to the first means for reducing the capacity of the fan means in response to increased demand for heated liquid. Preferably, the fan means comprise a plurality of individual fans which may be selectively rendered inoperable in order to vary the amount of air forced in heat exchange relationship with the air cooled condenser means. In order to sense the demand for heated liquid from the liquid cooled condenser means, means are provided for sensing the temperature of heated liquid entering said liquid cooled condenser means.

During those times when no demand for heated liquid exists, capacity control of the fan means is provided by fourth means responsive to third means which sense a condition related to ambient air temperature. Thus, as the temperature of air to be forced in heat exchange relationship with the air cooled condenser means decreases, the capacity of the fan means may be reduced. Fifth means are provided for rendering the fourth means inoperable during those times that a demand for heated liquid exists.

In a preferred embodiment, the air cooled condenser means and liquid cooled condenser means are connected in parallel flow relationship and the means for transferring condensed refrigerant therefrom to the evaporator means include receiver means having an outlet connected to the evaporator means, and first and second conduit means connecting the respective air cooled and liquid cooled condenser means to the receiver means. The aforesaid second conduit means is further provided with valve means therein for controlling the flow of condensed refrigerant therethrough and means are provided for sensing the level of codensed refrigerant in the liquid cooled condenser means and controlling said valve means so as to maintain a predetermined level therein. This is desirable since the liquid cooled condenser means includes a condenser section in its upper portion and a subcooling section in its lower postion, whereby the predetermined level may be maintained between said sections so as to insure adequate subcooling of the condensed refrigerant.

In order that adequate refrigerant pressure is maintained in the air cooled and liquid cooled condenser means during those times when a demand for heated liquid exists, first pressure regulating valve means are provided in the first conduit means which are selectivey operable in a first mode to increase said refrigerant pressure and in a second mode to permit free flow through the first conduit means. Similarly, in order to insure adequate pressure within the receiver means when a demand for heated liquid exists, third conduit means are provided between the compressor means and receiver means for transferring compressed vaporized refrigerant to the receiver means. The third conduit means include second pressure regulating valve means selectively operable in a first mode to maintain a predetermined pressure in the receiver means and in a second mode preventing flow through said third conduit means. The control means further include sixth means operable to place the first and second pressure regulating valve means in their first modes in response to a demand for heated liquid.

It has also been found advantageous to provide override means for placing the first and second pressure regulating valve means in their first modes irrespective of a demand for heated liquid in order to provide start-up of the refrigeration system during those times that the air cooled condenser means is exposed to low ambient temperatures.

Accordingly, it is an object of the present invention to provide a refrigeration system having both air cooled condenser means and liquid cooled heat recovery condenser means wherein the capacity of the air cooled condenser means is controlled during those times that a demand for heated liquid exists in response to such demand.

A second object of the invention is to provide a system as described in the preceding paragraph wherein means are provided for controlling the capacity of the air cooled condenser means during those times when no demand for heated liquid exists in response to ambient air temperature.

It is a further object to provide such a system having pressure regulating valve means selectively operable during those times that a demand for heated liquid exists in order to insure adequate refrigerant pressures within both the air and water cooled condenser means so as to produce heated liquid of a desired temperature and also to maintain adequate pressure within the receiver means in order to insure a supply of liquid refrigerant to the evaporator means.

It is yet a further object of the invention to provide means for maintaining a predetermined level of condensed refrigerant within the liquid cooled condenser means so as to insure adequate subcooling thereof during operation.

Yet a further object of the invention is to provide a control circuit including means for sensing the demand for heated liquid and means responsive thereto for controlling both the fan means associated with the air cooled condenser means and the first and second pressure regulating valve means.

Another object of the present invention is to provide a system as described wherein the control means include override means for placing the first and second pressure regulating valve means in their heat recovery modes so as to facilitate start-up of the system during those times that the air cooled condenser means is exposed to low ambient temperatures.

These and further objects of the invention will become apparent from the following description of a preferred embodiment and by reference to the accompanying drawings.

DESCRIPTION OF A PREFERRED EMBODIMENT

Figure 1:
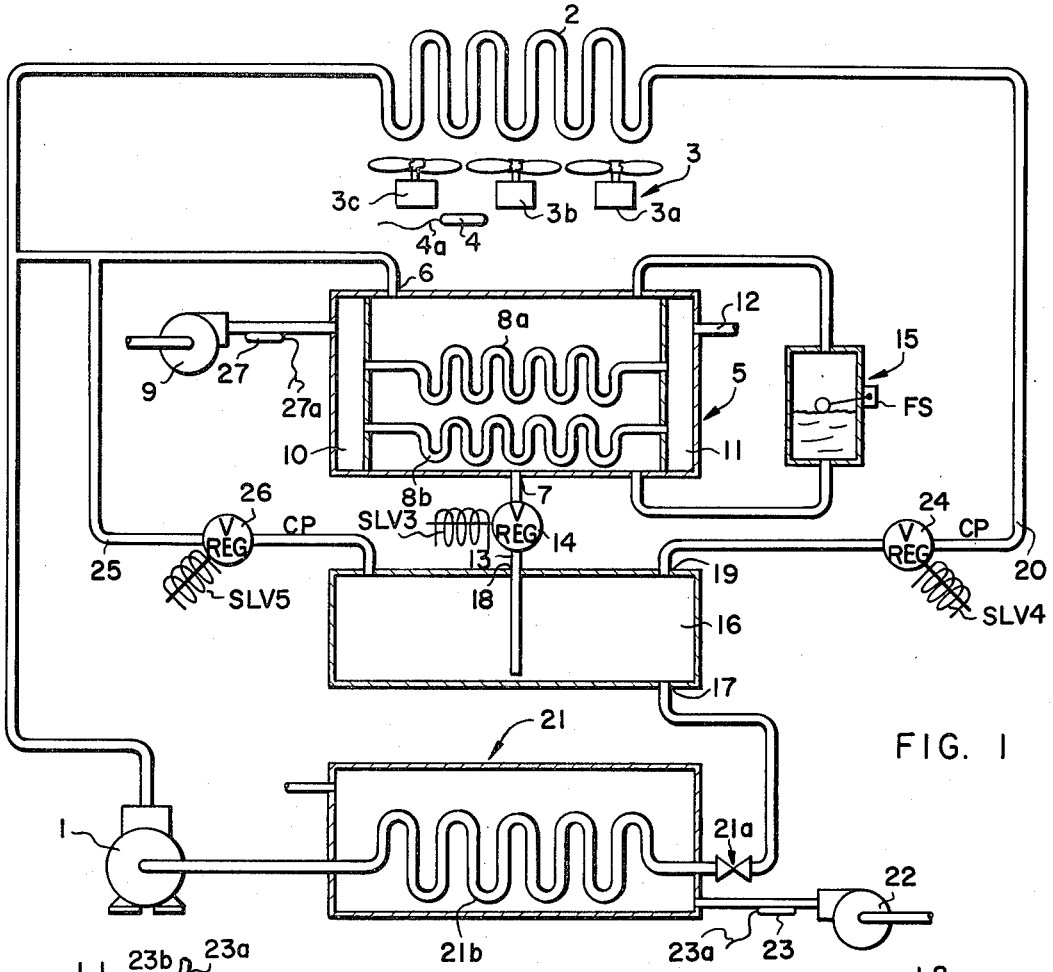
FIG. 1 is a schematic flow diagram of the system of the present invention.

Turning now to FIG. 1 of the drawings, the system of the present invention includes compressor means 1 for compressing a vaporized refrigerant which may comprise a commercially available compressor of the reciprocating type and may include unloading means for varying its capacity in response to demand of the refrigeration load.

Connected to compressor means 1 by conduit means as shown are air cooled condenser means 2 which preferably comprise a fin-and-tube type heat exchanger of well-known design and construction. Fan means indicated generally at 3 are provided for forcing ambient air in heat exchange relationship with air cooled condenser means 2 and, in the embodiment illustrated, comprise three individually operable fans 3*a* through 3*c*. Also illustrated adjacent air cooled condenser means 2 are means for sensing the temperature of the ambient air which is being forced in heat exchange relationship therewith and may comprise a conventional thermostatic bulb 4 having capillary tube 4*a* connected thereto for transmitting a pressure signal representative of the sensed air temperature.

It will be appreciated, however, that in lieu of thermostatic bulb 4, a series of bi-metal temperature responsive switches could be substituted for control of fans 3*a*, 3*b*, 3*c*.

Also connected to compressor means 1 by conduit means shown are liquid cooled condenser means indicated generally by the reference numeral 5. Liquid cooled condenser means 5 include a refrigerant inlet 6 disposed in an upper portion thereof and a refrigerant outlet 7 in a lower portion thereof. Disposed within condenser means 5 are heat exchange means for carrying a suitable liquid in heat exchange relationship with the compressed refrigerant, thereby to condense same and produce a heated liquid. As shown, such heat exchange means include an upper condenser section 8*a* and a lower subcooling secton 8*b* connected between a liquid inlet header 10 and liquid outlet header 11. Liquid to be heated is forced by pump means 9 into inlet header 10 through heat exchange sections 8*a* and 8*b*, into outlet header 11 and outlet conduit 12.

In order to maintain the level of condensed refrigerant in liquid cooled condenser means 5 at a desired level, second conduit means 13 are connected to refrigerant outlet 7 thereof and include valve means 14 therein for controlling the flow of condensed refrigerant. Valve means 14 are under the control of the level controller indicated generally at 15 which includes a switch FS for selectively energizing valve means 14 in order to maintain the desired level. This feature of the invention is important in that it insures that the level of liquid refrigerant in liquid cooled condenser means 5 will always be above subcooling heat exchange section 8*b*, thereby insuring adequate subcooling of said condensed refrigerant.

Receiver means 16 are provided having a first refrigerant inlet 18 for receiving condensed refrigerant from liquid cooled condenser means 5, and a second refrigerant inlet 19 for receiving condensed refrigerant from air cooled condenser means 2 via first conduit means 20. Refrigerant leaves receiver means 16 by way of outlet 17 and passes by conduit means shown to evaporator means indicated generally by the reference numeral 21.

Evaporator means 21 include an expansion device 21*a*, such as a conventional thermostatic expansion valve, for expanding and reducing the pressure of the condensed refrigerant. From expansion device 21*a*, the refrigerant passes through heat exchange means 21*b* wherein the refrigerant is vaporized in heat exchange relationship with the refrigeration load, such as the chilled liquid circuit shown associated with evaporator means 21. As shown, the chilled liquid circuit includes pump means 22 for forcing chilled liquid through the evaporator means and also includes temperature sensing means 23, 23*a* for sensing a demand for refrigeration within the system. In practice, means 23, 23*a* may comprise a thermostatic bulb similar to bulb 4 described with respect to air cooled condenser means 2.

Although the refrigeration load is illustrated to be a chilled liquid circuit, it is within the scope of the present invention to substitute therefore an air cooled direct expansion coil or other conventional refrigeration load as desired.

As shown, vaporized refrigerant leaves heat exchange means 21*b* and returns to compressor means 1 via conduit means shown.

It will be noted that first conduit means 20 which connect air cooled condenser means 2 to receiver means 16 also include first pressure regulating valve means 24. Valve means 24 comprise a combination solenoid-pressure regulating valve having a control solenoid SLV4 associated therewith. Operation of valve means 24 is such that, when solenoid SLV4 is in a first mode, a de-energized position, it acts as a pressure regulating valve to maintain a predetermined pressure upstream therefrom, thereby permitting control of the refrigerant pressure in the air cooled and liquid cooled condenser means. Upon energization of solenoid SLV4 to a second mode position, valve means 24 assume an "open" position so as to provide free flow of refrigerant through first conduit means 20.

Third conduit means 25 are provided connecting compressor means 1 and receiver means 16. Conduit means 25 include second pressure regulating valve means 26 which comprise a combination pressure regulating-solenoid valve having associated therewith solenoid SLV5. Operation of valve means 26 is such that, when SLV5 is energized in a first mode position, it permits flow of compressed refrigerant into receiver means 16 until a predetermined pressure is attained therein. Upon de-energization of solenoid SLV5 to its second mode position, however, valve means 26 assume a closed position to prevent flow of compressed refrigerant through third conduit means 25.

Associated with the heated liquid circuit described above, are means for sensing the demand for heated liquid which include means for sensing the temperature of heated liquid entering liquid cooled condenser means 5. As shown, such means comprise a thermostatic bulb 27 having associated capillary tube 27*a* for sensing the temperature and transmitting a pressure signal representative thereof to a controller.

OPERATION OF FIG. 1

During operation when there is no demand for heated liquid, the system of FIG. 1 operates as a conventional vapor compression refrigeration system with compressor means 1 operable to compress a vaporized refrigerant, air cooled condenser means 2 operative to condense said refrigerant, which then passes via first conduit means 20 through first pressure regulating valve means 24 (which is in its "open" position), and into receiver means 16. From there, the condensed refrigerant passes via outlet to evaporator means 21 where it is expanded and vaporized to satisfy a refrigeration load and thereafter return to compressor means 1. During operation in this mode, a small amount of compressed refrigerant will migrate to liquid cooled condenser means 5 and be condensed, resulting in a buildup of liquid refrigerant therein. For this reason, level control 15 is operative to periodically open valve means 14 and allow such refrigerant to pass into receiver means 16.

Assuming now that a demand for heated liquid from liquid cooled condenser means 5 exists, as sensed by thermostatic bulb 27, the control means to be described hereinafter will place first and second pressure regulating valve means 24 and 25, respectively in their first mode positions and will place control of air cooled condenser fan means 3 under the control of thermostatic bulb 27, as will be described in detail below.

In this mode of operation, the refrigerant pressure in air cooled condenser means 2 will increase due to the action of first pressure regulating valve means 24. This will also result in an increase in the pressure existing within liquid cooled condenser means 5 since it is also in communication with the discharge of compressor means 1. This is, of course, the desired result since, during heat recovery, it is necessary that the condensing pressure and temperature be maintained at a sufficiently high level to produce heated liquid of a predetermined desired temperature.

Level controller 15 is operable in the heat recovery mode just as it was in the refrigeration-only mode to maintain the predetermined level within liquid cooled condenser means 5 and thus insure proper subcooling, as described above.

Since evaporator means 21 will be constantly withdrawing liquid refrigerant from receiver means 16, and valve means 14 will be intermittently supplying it with condensed refrigerant, it is important that means are provided for maintaining adequate pressure therein during the heat recovery mode. As described above, this is the function of second pressure regulating valve means 26 which, upon a reduction of the pressure in receiver means 16, passes high pressure compressed refrigerant thereto in order to increase the pressure therein.

Upon satisfaction of the demand for heated liquid, as sensed by thermostatic bulb 27, the control means to be described immediately below will revert the system to its refrigeration-only mode of operation described above.

Turning now to the electrical control circuit illustrated in FIG. 2, its operation will be described by reference thereto and to the system operation described above.

In order to initiate operation of the refrigeration system and compressor means 1, a chilled liquid thermostat is provided having contact TCCL which close in response to a demand for chilled liquid as sensed by thermostatic bulb 23 and transmitted to thermostatic bellows 23*b* via capillary tube 23*a*. Assuming that the chilled liquid flow sensing switch FSCL is closed, relay CR will thereby be energized to close its contacts CR1 to energize compressor contactor CC, thereby effecting operation of compressor means 1.

Figure 2:
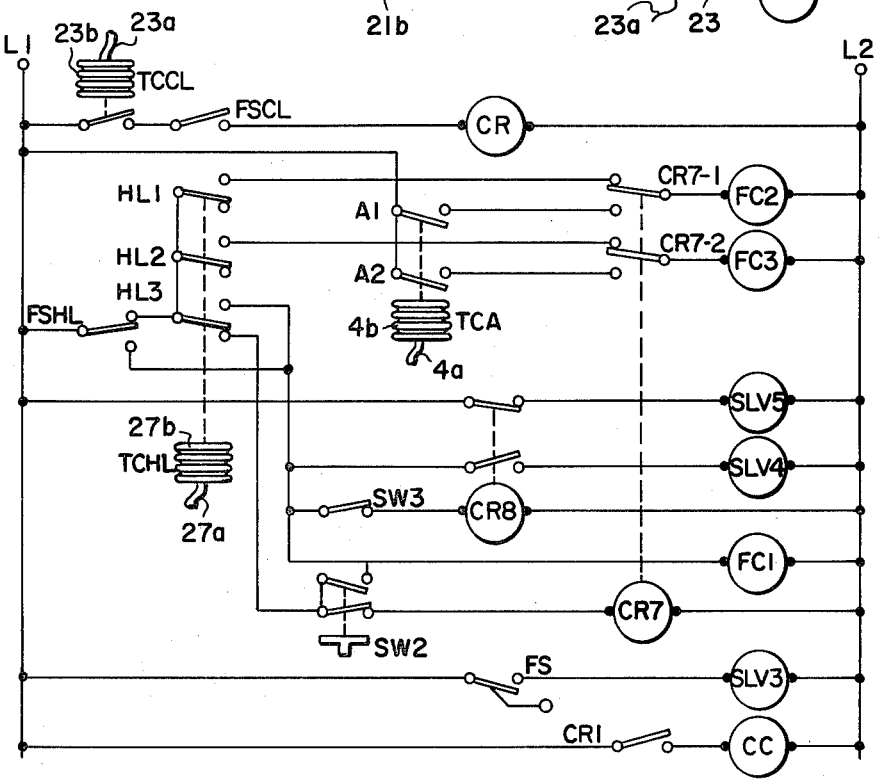
FIG. 2 is a schematic diagram of an electrical control circuit suitable for use with the system of FIG. 1.

It should be noted at this time that the contacts of the remaining switches illustrated in FIG. 2 are in a position which assumes that heated liquid pump means 9 are in operation and that a demand exists for heated liquid, as sensed by thermostatic bulb 27, which is not yet been satisfied.

The elements illustrated in the circuit of FIG. 2 include fan contactors FC1, FC2, and FC3 for energizing the individual fans illustrated at 3*a*, 3*b*, and 3*c*, respectively, which force ambient air in heat exchange relationship with air cooled condenser means 2. Also shown are solenoids SLV3, SLV4, and SLV5 for energizing valve means 14, first pressure regulating valve means 24, and second pressure regulating valve means 26.

A heated liquid thermostat is provided at TCHL which includes thermostatic bellows 27*b* operable to receive a thermostatic pressure signal from bulb 27 via capillary tube 27*a*. Upon an increase in the sensed temperature, bellows 27*b* expand and impose a force upon its three associated switches HL1, HL2, and HL3. These switches are designed so as to close in sequence upon an increase in the sensed temperature such that HL1 is the first to close, followed by HL2, and lastly by HL3. They are designed so as to be "snap-acting" such that the switch members are always in positive contact with one or the other of their associated contacts.

A second thermostat is provided in the circuit of FIG. 2 at TCA which responds to ambient temperature sensed by thermostatic bulb 4 whose signal is transmitted to bellows 4*b* via capillary tube 4*a*. Thermostat TCA includes two sets of contacts A1 and A2 which are similar to those described with respect to thermostat TCHL, with switch A1 being the first to close, followed by switch A2, upon an increase in the sensed temperature. It is the function of thermostat TCA to control operation of the air cooled condenser fan means 3 during those times when no demand for heated liquid exists.

Considering now the operation of the circuit of FIG. 2 during those times when a demand for heated liquid exists, heated liquid flow switch FSHL will be in its position shown so as to energize switches HL1, HL2, and HL3 of thermostat TCHL. Note that in this position switch HL3 is operative to energize relay CR7 via manually operated switch SW2, thereby placing switches CR7-1 and CR7-2 in their illustrated positions. Upon an increase in the temperature of heated liquid entering liquid cooled condenser means 5, bellows 27*b* will expand and initially close switch HL1 which, as shown, is operative to energize fan contactor FC2 via contacts CR7-1. Assuming that the temperature of the heated liquid continues to increase, indicating that the demand is being satisfied, switch HL2 will also close in order to energize fan contactor FC3 via contacts CR7-2. Thus, the capacity of air cooled condenser means 2 will be increased as the demand for heated liquid is being satisfied. When the temperature of the heated liquid reaches the desired temperature, indicating that demand therefor no longer exists, switch HL3 will move from its position shown to de-energize relay CR7, thereby moving switches CR7-1 and CR7-2 to their lower positions. Also as a result of movement of switch HL3 from its position shown to its upper contact, relay CR8 will be energized via closed manual switch SW3 in order to energize solenoid SLV4 and de-energize solenoid SLV5, thereby changing the positions of first pressure regulating valve means 24 and second pressure regulating valve means 25 from their first mode to second mode positions described above. Under these conditions, contactor FC1 will be energized in order to provide operation of fan 3*a* while fans 3*b* and 3*c* will be under the control of thermostat TCA.

Depending upon the ambient temperature sensed by thermostatic bulb 4, switches A1 and A2 may be both opened, both closed, or only switch A1 may be closed; thereby providing selective operation of both fans 3*b* and 3*c*, neither of them, or only fan 3*b*. Note that thermostat TCA gains control of contactors FC2 and FC3 due to the change in position of switches CR7-1 and CR7-2 which occurs in response to satisfaction of the demand for heated liquid.

Assuming now that a demand for heated liquid again appears, switch HL3 will be the first to return to its illustrated position so as to provide heat recovery operation as described above wherein control of fan contactors FC2 and FC3, respectively, returns to switches HL1 and HL2.

A manually operable switch SW3 is provided in the circuit of FIG. 2 which may be used when the heated liquid flow circuit is inoperable, resulting in movement of flow switch FSHL to its lower position, in order to provide start-up of the refrigeration system under conditions when the air cooled condenser means 2 is exposed to low ambient conditions. This is done by manually opening switch SW3 prior to start-up, thereby de-energizing relay CR8 in order to place solenoids SLV4 and SLV5 in their first mode heat recovery positions such that first pressure regulating valve means 24 is operable to buildup refrigerant pressure in the air cooled and liquid cooled condenser means while second pressure regulating valve means 26 is operable to pass high pressure compressed refrigerant to receiver means 16 in order to force liquid refrigerant therefrom into evaporator means 21 whereby it may be vaporized and compressed in order to effect "flooding" of air cooled condenser means 2. Once air cooled condenser means 2 is flooded sufficiently to reduce its capacity at the low ambient temperature encountered, switch SW3 will be manually closed and operation of the system will proceed in a refrigeration-only mode until such time as the heated liquid flow circuit may be activated.

Also included in the circuit of FIG. 2 is an emergency switch SW2 which is operable during operation in the heat recovery mode to revert control of fan means 3 to ambient thermostat TCA. It will be apparent that, upon movement of switch SW2 to its upper position, fan contactor FC1 will be energized while relay CR7 will be de-energized in order to move switches CR7-1 and CR7-2 to their lower positions in which contactors FC2 and FC3, respectively, are under the control of switches A1 and A2.

For the sake of clarity, float switch FS has been illustrated in FIG. 2 to show that it is always operable to maintain the predetermined refrigerant level in liquid cooled condenser means 5.

Although the refrigeration system illustrated as a preferred embodiment incorporates air cooled condenser means 2 and liquid cooled condenser means 5 in parallel flow relationship, it will be appreciated by those skilled in the art that they could also be placed in series flow relationship while still attaining certain objects of the present invention and without departing from the spirit thereof.

Similarly, it is possible that, in lieu of sensing ambient temperature in order to control fan means 3 during those times when no demand for heated liquid exists, a condition related thereto such as condenser pressure may be sensed.

It will be further appreciated that, although the preferred embodiment illustrated includes three individual fans, the exact number to be provided in a particular system is dependent upon the refrigeration capacity thereof and the number three is not to be considered in any way limiting.

Accordingly, while the invention has been described with respect to a preferred embodiment, it is to be understood that modifications as aforesaid will be apparent to those skilled in the art within the scope and spirit of the invention as defined in the claims which follow.

I claim:

1. A system for producing refrigeration and selectively operable for producing a heated liquid comprising a. compressor means for compressing a vaporized refrigerant;

b. air cooled condenser means connected to said compressor means for receiving compressed refrigerant and condensing same by heat exchange with a source of air, further including fan means for forcing said air in heat exchange relationship with said air cooled condenser means;

c. liquid cooled condenser means connected to said compressor means in parallel flow relationship with said air cooled condenser means for receiving compressed refrigerant and condensing same by heat exchange with a source of liquid, whereby a heated liquid is produced;

d. evaporator means for expanding and vaporizing said condensed refrigerant in heat exchange relationship with a refrigeration load and returning the vaporized refrigerant to said compressor means;

e. means for transferring condensed refrigerant from said air cooled and liquid cooled condenser means to said evaporator means and comprising i. receiver means having a condensed refrigerant outlet connected to said evaporator means;

ii. first conduit means connecting said air cooled condenser means to said receiver means;

iii. second conduit means connecting said liquid cooled condenser means to said receiver means and including valve means therein for controlling the flow of condensed refrigerant through said second conduit means; and iv. means for sensing the level of condensed refrigerant in said liquid cooled condenser means and controlling said valve means so as to maintain a predetermined level therein during operation of said system, whether or not heated liquid is being produced by said liquid cooled condenser means.

2. The system of claim 1 wherein said liquid cooled condenser means include a condenser section in its upper portion and a subcooling section in its lower portion, said predetermined level lying between said condenser section and said subcooling section.

3. The system of claim 1 wherein said first conduit means include first pressure regulating valve means selectively operable in a first mode to increase the refrigerant pressure in said air cooled and liquid cooled condenser means, and in a second mode to permit free flow through said first conduit means, further comprising control means including i. first means for sensing the demand for heated liquid from said liquid cooled condenser means; and ii. sixth means responsive to said first means for placing said first pressure regulating valve means in its first mode in response to a demand for heated liquid.

4. The system of claim 3 further comprising third conduit means connected to said compressor means and said receiver means for transferring compressed vaporized refrigerant to said receiver means and including second pressure regulating valve means selectively operable in a first mode to maintain a predetermined pressure in said receiver means and in a second mode preventing flow through said third conduit means, said sixth means being further operable to place said second pressure regulating valve means in its first mode in response to a demand for heated liquid.

5. The system of claim 1 further comprising first pressure regulating valve means operatively associated therewith so as to control the flow of refrigerant therein and selectively operable in a first mode to increase the refrigerant pressure in said air cooled and liquid cooled condenser means, further comprising control means including i. first means for sensing the demand for heated liquid from said liquid cooled condenser means; and ii. sixth means responsive to said first means for placing said first pressure regulating valve means in its first mode in response to a demand for heated liquid.

* * * * *